US007438648B2

(12) United States Patent
Wahl et al.

(10) Patent No.: US 7,438,648 B2
(45) Date of Patent: Oct. 21, 2008

(54) GOLF PUTTER HEAD

(75) Inventors: Bret H. Wahl, Escondido, CA (US); Mike Walker, Vista, CA (US); Robert Nunez, San Pedro, CA (US); Marni Ines, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 76 days.

(21) Appl. No.: 11/640,129

(22) Filed: Dec. 15, 2006

(65) Prior Publication Data

US 2008/0146371 A1 Jun. 19, 2008

(51) Int. Cl.
*A63B 53/04* (2006.01)

(52) U.S. Cl. ..... 473/340; 473/345; 473/350

(58) Field of Classification Search ..... None
See application file for complete search history.

(56) References Cited

U.S. PATENT DOCUMENTS

D232,371 S * 8/1974 Becker ..... D21/741
D234,962 S * 4/1975 Swash ..... D21/739
D235,668 S * 7/1975 Swash ..... D21/739
4,121,833 A * 10/1978 Prueter ..... 473/330
5,080,365 A * 1/1992 Winchell ..... 473/255
5,417,429 A 5/1995 Strand
5,630,765 A * 5/1997 Moore ..... 473/252
D389,539 S * 1/1998 Moore ..... D21/739
5,820,481 A * 10/1998 Raudman ..... 473/313
5,830,078 A * 11/1998 McMahan ..... 473/252
6,488,595 B1 * 12/2002 Grace ..... 473/341
6,652,390 B2 11/2003 Bradford
6,796,911 B2 * 9/2004 Grace ..... 473/251
D502,236 S * 2/2005 Grace ..... D21/743
6,896,625 B2 * 5/2005 Grace ..... 473/251
D507,316 S * 7/2005 Li ..... D21/742
D507,317 S * 7/2005 Garner et al. ..... D21/743
6,929,559 B1 * 8/2005 Grace ..... 473/251
6,960,140 B2 * 11/2005 Solheim et al. ..... 473/251
6,966,845 B2 * 11/2005 Solheim et al. ..... 473/251
6,974,394 B1 * 12/2005 Tang et al. ..... 473/335
6,988,956 B2 * 1/2006 Cover et al. ..... 473/244
6,988,959 B2 * 1/2006 Pollman ..... 473/313
7,004,849 B2 * 2/2006 Cameron ..... 473/249
7,018,304 B2 3/2006 Bradford
D521,088 S * 5/2006 Mercier ..... D21/736
7,048,639 B2 * 5/2006 Grace ..... 473/251
7,048,646 B2 * 5/2006 Yamanaka et al. ..... 473/332
7,052,411 B2 * 5/2006 Solheim et al. ..... 473/251
D523,102 S * 6/2006 Stites et al. ..... D21/742
7,086,957 B2 * 8/2006 Solheim et al. ..... 473/251
D529,108 S * 9/2006 Stites et al. ..... D21/736

(Continued)

OTHER PUBLICATIONS

Nike Black OZ T130 Putter, http://www.nike.com/nikegolf/flash_reg.jhtml.

(Continued)

*Primary Examiner*—Gene Kim
*Assistant Examiner*—Alvin A Hunter
(74) *Attorney, Agent, or Firm*—John L. Rogitz

(57) ABSTRACT

A high inertia golf putter head is generally wedge-shaped, with the leading face being less wide than the trailing face. Cavities and weights are provided to optimize the moment of inertia.

16 Claims, 3 Drawing Sheets

U.S. PATENT DOCUMENTS

| | | | | |
|---|---|---|---|---|
| 7,147,569 | B2 * | 12/2006 | Tang et al. | 473/249 |
| 7,156,759 | B2 * | 1/2007 | Pollman | 473/409 |
| 7,160,203 | B2 * | 1/2007 | Bonneau | 473/334 |
| 7,163,469 | B2 * | 1/2007 | Bonneau | 473/334 |
| 7,175,537 | B2 * | 2/2007 | Pollman | 473/203 |
| D538,364 | S * | 3/2007 | Frame et al. | D21/736 |
| D540,897 | S * | 4/2007 | Oldknow et al. | D21/736 |
| 7,204,765 | B2 * | 4/2007 | Cover et al. | 473/244 |
| D541,894 | S * | 5/2007 | Imamoto | D21/736 |
| D542,873 | S * | 5/2007 | Oldknow et al. | D21/759 |
| D545,385 | S * | 6/2007 | Tang et al. | D21/736 |
| 7,235,021 | B2 * | 6/2007 | Solheim et al. | 473/251 |
| 7,244,191 | B2 * | 7/2007 | Tang et al. | 473/335 |
| D548,295 | S * | 8/2007 | Jertson et al. | D21/736 |
| 7,255,650 | B2 * | 8/2007 | Braynt et al. | 473/252 |
| 7,326,121 | B2 * | 2/2008 | Roake | 473/251 |
| D564,606 | S * | 3/2008 | Oldknow et al. | D21/736 |
| 7,344,451 | B2 * | 3/2008 | Tang et al. | 473/340 |
| 7,351,162 | B2 * | 4/2008 | Soracco et al. | 473/335 |
| 7,354,356 | B2 * | 4/2008 | Yamanaka et al. | 473/332 |
| 2004/0138003 | A1 * | 7/2004 | Grace | 473/334 |
| 2004/0138004 | A1 * | 7/2004 | Grace | 473/340 |
| 2004/0166953 | A1 * | 8/2004 | Grace | 473/251 |
| 2004/0173964 | A1 * | 9/2004 | Pollman | 273/252 |
| 2005/0137027 | A1 * | 6/2005 | Thomas | 473/340 |
| 2005/0159240 | A1 * | 7/2005 | Solheim et al. | 473/340 |
| 2005/0159242 | A1 * | 7/2005 | Solheim et al. | 473/340 |
| 2005/0221912 | A1 * | 10/2005 | Solheim et al. | 473/340 |
| 2005/0227777 | A1 * | 10/2005 | Cover et al. | 473/251 |
| 2005/0227778 | A1 * | 10/2005 | Pollman | 473/252 |
| 2005/0233828 | A1 * | 10/2005 | Bonneau | 473/340 |
| 2005/0239574 | A1 * | 10/2005 | Rohrer | 473/340 |
| 2005/0282657 | A1 * | 12/2005 | Solheim et al. | 473/340 |
| 2006/0014590 | A1 * | 1/2006 | Tao | 473/249 |
| 2006/0030420 | A1 * | 2/2006 | Roake | 473/251 |
| 2006/0035718 | A1 * | 2/2006 | Soracco et al. | 473/251 |
| 2006/0040763 | A1 * | 2/2006 | Soracco et al. | 473/324 |
| 2006/0040764 | A1 * | 2/2006 | Soracco et al. | 473/335 |
| 2006/0052178 | A1 * | 3/2006 | Franklin et al. | 473/340 |
| 2006/0068934 | A1 * | 3/2006 | Tang et al. | 473/335 |
| 2006/0094533 | A1 * | 5/2006 | Warren et al. | 473/337 |
| 2006/0166755 | A1 * | 7/2006 | Brown | 473/251 |
| 2007/0049395 | A1 * | 3/2007 | Solheim et al. | 473/251 |
| 2007/0178988 | A1 * | 8/2007 | Tavares et al. | 473/334 |
| 2007/0191135 | A1 * | 8/2007 | Nilsson et al. | 473/340 |
| 2007/0238547 | A1 * | 10/2007 | Jones | 473/340 |
| 2007/0238550 | A1 * | 10/2007 | Tateno | 473/340 |
| 2007/0259734 | A1 * | 11/2007 | Pollman | 473/313 |
| 2007/0293346 | A1 * | 12/2007 | Rollinson et al. | 473/340 |

OTHER PUBLICATIONS

Unitized Techno Putter, http://www.nike.com/nikegolf/flash_reg.jhtml.

Fourteen, BR-II Head Specifications, http://www.fourteengolf.com/product/putter/br-3/index.html.

Never Compromise GM2 Exchange 1, http://www.nevercompromise.com/nevercompromise.html.

Never Compromise GM2 Exchange 1, http://www.nevercompromise.com/nevercompromise.html (top view).

Never CompromiseGM2 Exchange 1, http://www.nevercompromise.com/nevercompromise.html (bottom view).

Never Compromise GM2 Exchange 2, http://www.nevercompromise.com/nevercompromise.html (side view).

Never Compromise GM2 Exchange 2, http://www.nevercompromise.com/nevercompromise.html (top angle).

Never Compromise GM2 Exchange 3, http://www.nevercompromise.com/nevercompromise.html (side view).

Never Compromise GM2 Exchange 3, http://www.nevercompromise.com/nevercompromise.html.

Never Compromise GM2 Exchange 3, http://nevercompromise.com/nevercompromise.html (bottom view).

* cited by examiner

GOLF PUTTER HEAD

FIELD OF THE INVENTION

The present invention relates generally to golf putter heads.

BACKGROUND OF THE INVENTION

In a perfect putt, the golfer strikes the ball exactly on the sweet spot of the putter head. This prevents the putter head from twisting about the axis defined by the golf club shaft, which otherwise leads to poorly aligned putts, because when the sweet spot is missed, the inertia of the ball imparts a torque to the golf club shaft. The torque increases in proportion to the distance by which the sweet spot is missed.

Accordingly, putter heads having high moments of inertia to resist the torque caused by missing the sweet spot have been provided. Putter heads having high moments of inertia may be relatively wide and may have weights placed at various locations to improve performance. An example of such a head is set forth in U.S. Pat. No. 7,048,639, in which a large triangular head has a leading face that is greater in breadth than the trailing face. An example of a putter with weights is disclosed in U.S. Pat. No. 6,974,394. As recognized herein, additional improvements in terms of moment of inertia and/or sweet spot strike guiding can be provided.

SUMMARY OF THE INVENTION

A golf putter head is provided with a high moment of inertia (MOI) about the vertical axis through the head's center of gravity and also about the heel-to-toe axis through the center of gravity for stability. This is achieved by a hollow design in which most of the mass of the head is disposed rearwardly on the head and is spaced laterally from the swing axis.

Accordingly, a golf putter head includes a unitary body that defines a continuous top edge in turn defining a top leading edge, a top trailing edge, and top heel and toe edges extending from respective ends of the top trailing edge to respective ends of the top leading edge. Tangents to the heel and toe edges intersect at a point in front of the top leading edge. The body also defines a sole edge having a sole leading edge parallel to and coplanar with the top leading edge and sole heel and toe edges parallel to and coplanar with the top heel and toe edges. A generally rectilinear sole plate extends from and is integral with the sole leading edge and is joined to the top trailing edge. The sole plate is distanced from the sole heel and toe edges by respective cavities. The body further includes heel and toe wings extending laterally outwardly from the top heel and toe edges adjacent the top leading edge. The heel and toe wings do not, however, extend laterally as far as the ends of the top trailing edge. A striking insert is disposed on the body between the top and sole leading edges for striking a golf ball.

In non-limiting implementations the wings extend from the top leading edge to the sole leading edge. Heel and toe weights may be disposed on opposite sides of the sole plate closer to the top trailing edge than the top leading edge. The sole heel and toe edges can curve inwardly and up to the top trailing edge.

If desired, a central plate can be provided on the body to extend from the sole plate to the top leading and trailing edges. The central plate is oriented to also extend in a leading-to-trailing dimension centrally on the body and perpendicular to the sole plate. The central plate may define a visible top surface bearing an alignment aid.

In another aspect, a putter head has a substantially hollow unitary body with a generally wedge-shaped periphery and a leading surface less wide in a heel-to-toe dimension than a trailing portion of the head. Leading heel and toe wings extend laterally outward from the periphery adjacent the leading surface to partially define the leading surface.

In yet another aspect, a putter head has a leading surface configured for striking a golf ball, a trailing edge wider than the leading surface in a heel-to-toe dimension, and a central plate extending in a cavity formed therebetween and bearing alignment indicia visible to a golfer.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
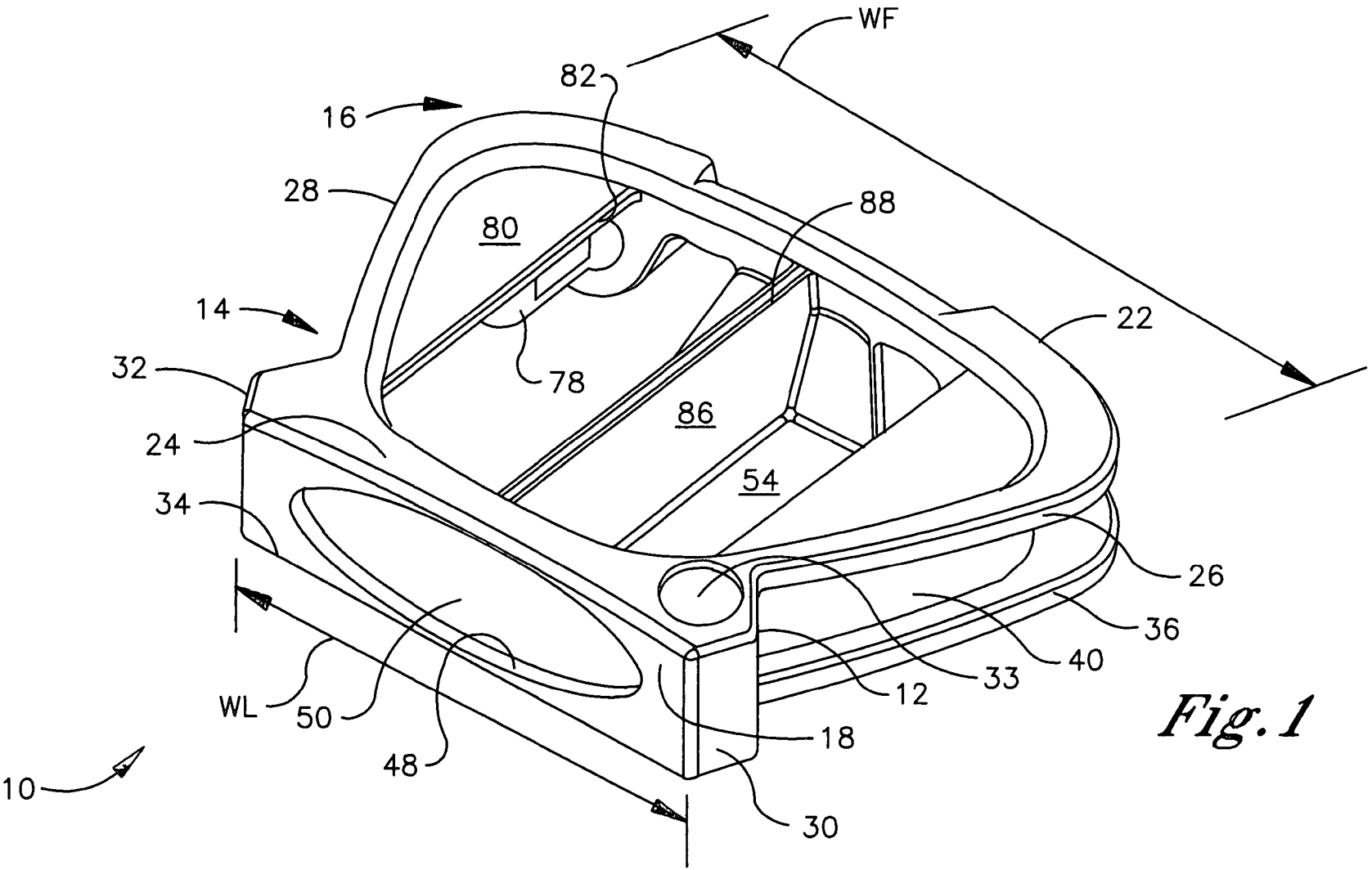
FIG. 1 is a perspective view of the putter head looking at the leading face from the top of the head.
Figure 2:
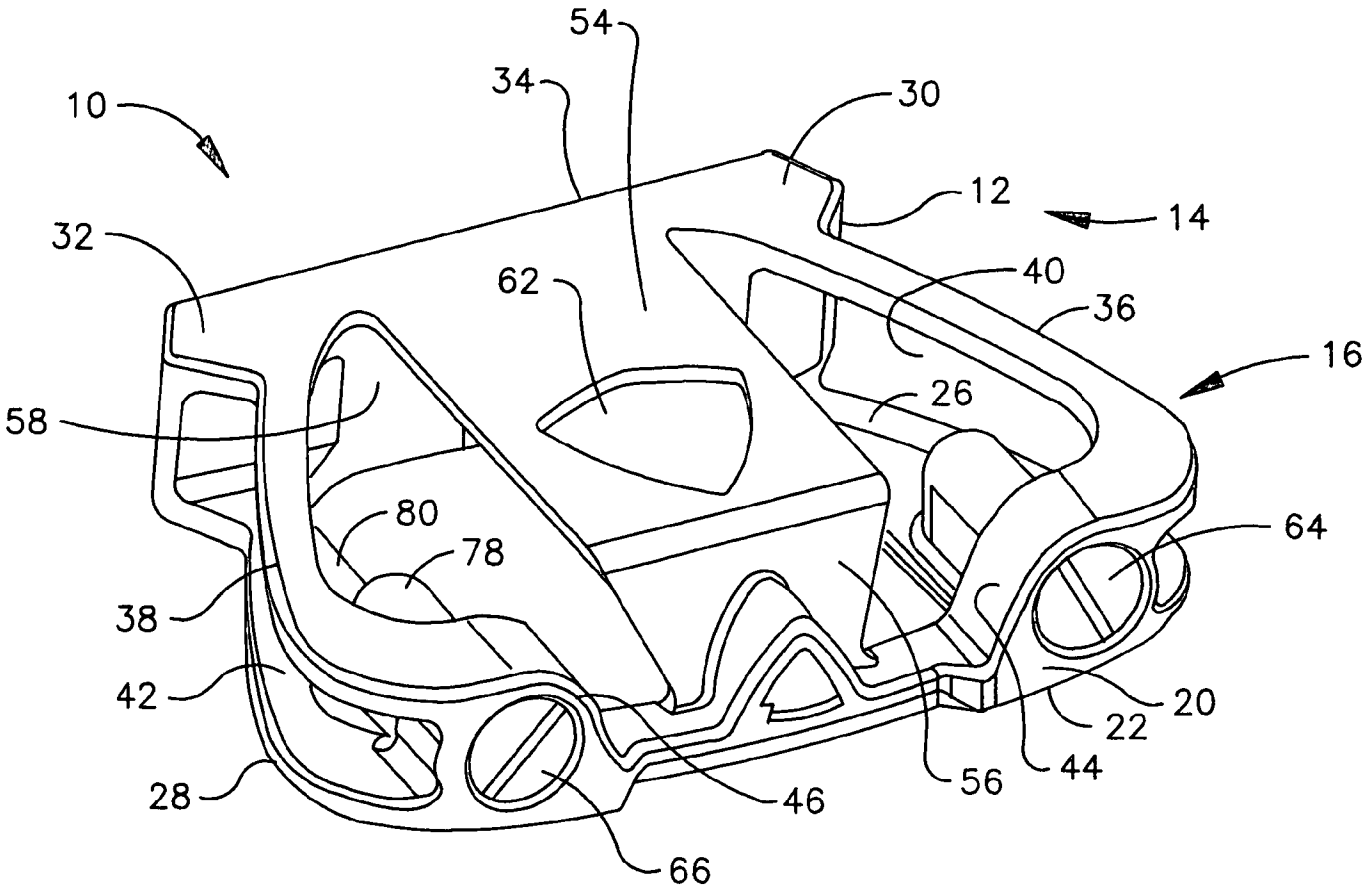
FIG. 2 is a perspective view of the putter head looking at the trailing face from the sole of the head.

Referring initially to FIGS. 1 and 2, a golf putter head 10 includes a generally wedge-shaped unitary body 12 that has a narrower leading edge than a wider trailing portion as set forth further below.

As used herein, terms of direction/dimension are relative to the orientation the body 12 has when viewed by a golfer looking down on the head 10 while bringing the head 10 through a golf ball as intended. Thus, a "heel" part is closer to the golfer during the swing than a "toe" part; a "sole" part faces the ground during the swing and an opposed "top" part is what is seen by the golfer; and a "leading" part leads a "trailing" part through the ball during the ball striking (forward) part of the stroke.

As shown in FIGS. 1 and 2, the body 12 defines a leading portion 14 for striking a golf ball and a trailing portion 16. The leading portion 14 defines a flat leading face 18 having a width "WL" in the heel-to-toe dimension of the head 10 that is less than the greatest width "WF" of the trailing portion 16. In non-limiting embodiments the width "WF" is preferably 85 mm-127 mm, more preferably 95 mm-117 mm, most preferably 104 mm-108 mm, and may be one hundred six millimeters. The width "WL" of the leading face 18 is preferably 58 mm-86 mm, more preferably 65 mm-79 mm, most preferably 70 mm-74 mm. When WF is about 106 mm WL may be about seventy two millimeters. The face 18 can be milled if desired.

The top of the trailing end 20 of the trailing portion 16 defines a trailing edge 22. The trailing edge 22 extends substantially completely across the width of the trailing end 20 and is straight or, as shown, gently convex, in contrast to, e.g., the discontinuous slope of the wing-shaped structure shown in U.S. Pat. No. 6,652,390. In any case, the periphery of the body 12 shown in FIG. 1 has a relatively long trailing edge 22 and a relatively shorter leading edge 24 above the leading face 18, and there is no structure in the plane of the leading face 18 that extends laterally past the leading edge.

Figure 3:
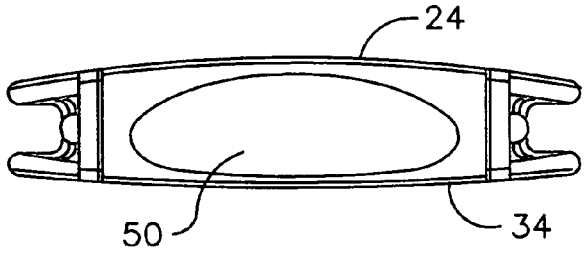
FIG. 3 is an elevational view of the leading face.

With more specificity and as best shown in FIG. 1, the body 12 defines a continuous top edge that in turn defines the top leading edge 24, the top trailing edge 22, and top heel and toe edges 26, 28 extending from respective ends of the top trailing edge 22 to respective end portions of the top leading edge 24. As also shown, heel and toe wings 30, 32 may be provided to extend laterally outwardly from the top heel and toe edges 26, 28 adjacent the top leading edge 24 to partially define the leading surface 18. The heel and toe wings 30, 32 do not extend laterally as far as the ends of the top trailing edge 22. The wings 30, 32 can extend continuously from the top leading edge 24 to a sole leading edge 34, and a hosel hole 33 can be formed in the heel wing 30 near the leading face 18 for receiving a hosel (not shown) of a putter shaft. Referring briefly to FIG. 3, the top and sole leading edges 24, 34 may be straight or slightly convex in the heel-to-toe dimension.

Now turning to the sole of the body 12 best shown in FIG. 2, the body 12 also defines a sole edge having a sole leading edge 34 that is parallel to (in the heel-to-toe dimension) and coplanar with (in the top-to-sole dimension) the top leading edge 24, with the leading face 18 extending therebetween. The sole edge also defines sole heel and toe edges 36, 38 that are parallel to and coplanar with the top heel and toe edges 26, 28 and spaced therefrom as shown, i.e., heel and toe gaps 40, 42 in which no structure is formed extend between the top heel and toe edges 26, 28 and their respective sole heel and toe edges 36, 38. The sole heel and toe edges 36, 38 can curve inwardly and up at segments 44 and 46 to join the top trailing edge 22. In the leading portion of the body 12, on the other hand, the sole heel and toe edges 36, 38 remain in the sole plane to join the soles of the wings 30, 32 as shown.

In any case, it may be appreciated from FIGS. 1 and 2 that the trailing portion 16 and leading portion 14 (exclusive of the wings 30, 32) define a generally wedge shape, with tangents to the heel and toe edges converging at a point in front of the leading face 18.

FIG. 1 best shows that the leading face 18 is formed centrally with a pocket 48 that does not extend completely through the body 12 but instead establishes a depression into which a strike insert 50 is disposed flush with the leading face 18 for striking a golf ball. The strike insert 50 is any suitable metal or plastic insert that gives a pleasing and effective "feel" to a golfer when the insert 50 strikes a golf ball.

A generally rectilinear flat sole plate 54 extends from and is integral with the sole leading edge 34 and resides in the sole plane of the body 12. The sole plate 54 is joined to the top trailing edge 22 by an upwardly ramping integral connector plate 56. Further, the sole plate 54 is distanced from the sole heel and toe edges 36, 38 in the sole plane by respective cavities 58, 60, each of which, owing to the straight edges of the sole plate 54 in combination with the generally wedge shape of the periphery of the body 12, is generally shaped as a right triangle. If desired, a badge depression 62 may be formed in the sole plate 54, and a badge (not shown) that is configured identically to the depression 62 may be disposed therein flush with the sole surface of the sole plate 54.

Figure 4:
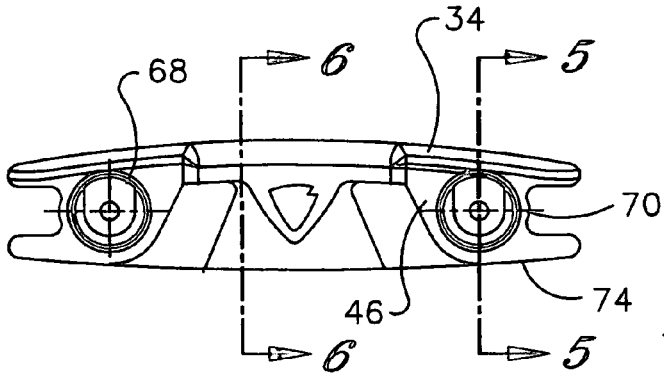
FIG. 4 is an elevational view of the trailing portion.

Cross-referencing FIGS. 2 and 4, heel and toe weights 64, 66 (FIG. 2) may be disposed on opposite sides of the sole plate 54 closer to the top trailing edge 22 than to the top leading edge 24. The weights 64, 66 may be made of a material having a density greater than the density of the material of the body 12. The weights 64, 66 may be made of a brass material. Alternatively and without limitation, the weights may be made of stainless steel, tungsten, silver, gold, nickel, nickel based alloys, iron based alloys, tin, copper and platinum. The two weights 64, 66 are preferably equal in weight.

Figure 5:
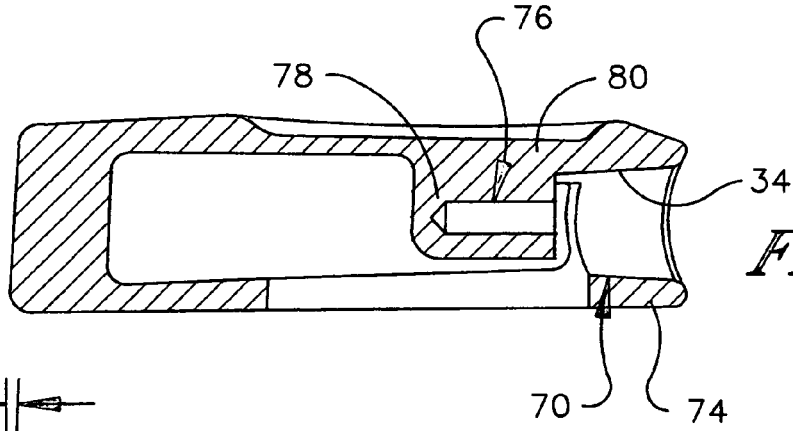
FIG. 5 is a cross-section as seen along the line 5-5 in FIG. 4.

In any case, as be seen in reference to FIGS. 4 and 5, the weights 64, 66 are respectively disposed in complementarily-shaped weight receptacles 68, 70 that extend from the trailing end of the body 12 just below the top trailing edge 22 toward the leading portion 14. Taking the toe receptacle 70 as an example, the receptacle 70 can have an enlarged hollow cylindrical part 72 that is established by inner arcuate walls of the top trailing edge 22, the sloping segment 46, and a sole trailing edge portion 74. As shown in FIG. 5, the enlarged hollow cylindrical part 72 may taper slightly inwardly toward the leading portion 14.

Additionally, the receptacle 70 can include a cylindrical shank receiving part 76 for receiving an elongated solid cylindrical shank of the weight 66. The shank receiving part 76 can be established by an otherwise solid shank receiver 78 that is formed on a thin flat top receptacle plate 80 (best shown in FIGS. 1 and 2 and also shown in FIG. 5). The top receptacle plate 80 merges into the junction of the top trailing edge 22 with the top toe edge 28 as best shown in FIG. 1. Similar weight receptacle structure is mirrored on the opposite (heel) part of the body 12. It will readily be appreciated looking at FIG. 1 that the inside edge 82 of the top receptacle plate 80 is parallel to the central axis of the body 12.

Indeed, with further respect to this central axis, as best shown in FIG. 1 a thin, flat, solid, parallelepiped-shaped central plate 86 can extend up from the sole plate 54, with which it is integral, to the top leading and trailing edges 24, 22 as shown. The central plate 86 is oriented to also extend in a leading-to-trailing dimension centrally on the body 12 along the axis of the body 12 between the leading and trailing edges of the body 12. The central plate 86 is perpendicular to the sole plate 54 and can define a visible top surface bearing an alignment aid 88 such as a white stripe.

Figure 6:
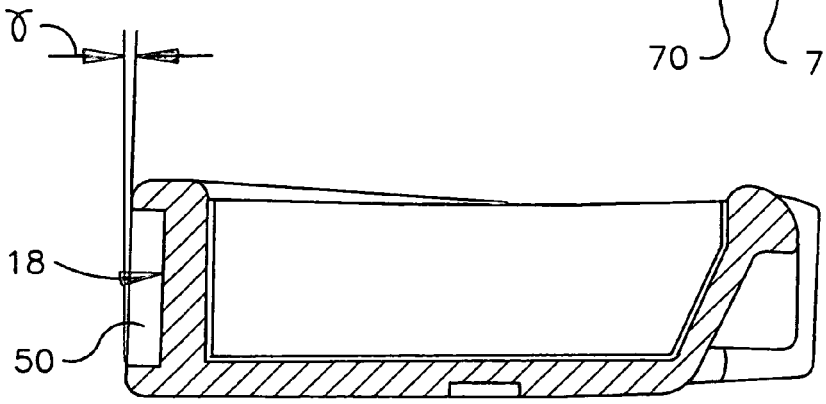
FIG. 6 is a cross-section as seen along the line 6-6 in FIG. 4.

Completing the description of the body 12, FIG. 6 shows that if desired, the leading surface 18 may have a slight loft angle $\alpha$ of, e.g., three degrees or so.

The above-described structure results in most of the mass of the head being rearward and laterally spaced from the swing centerline axis of the body 12. The ratio of the width of the leading surface of the body 12 to the largest width of the trailing portion can be, in non-limiting implementations, 0.54 to 0.82, more preferably 0.61 to 0.75, and most preferably 0.65 to 0.71; the ratio may be 0.68. In a particular embodiment approximately ten percent or more of the mass of the head is laterally spaced outside the heel and toe edges of the leading surface. Indeed, in non-limiting implementations approximately nine percent of the mass of the head is both rearward of the geometric center of the body 12 and is laterally spaced outside the heel and toe edges of the leading surface, it being understood that the geometric center of the body is located at about 50% of the maximum distance between the leading and trailing edges within the discussion below. With the structure set forth herein, the moment of inertia (MOI) about the vertical axis (i.e., in the top-to-sole dimension) through the head's center of gravity can be, e.g., greater than 410 kg-mm2, more preferably greater than 460 kg-mm2, and most preferably greater than 500 kg-mm2, and may be five hundred eight kilogram-square millimeter, while the ratio of the MOI about the heel-to-toe axis through the center of gravity to the vertical MOI can be high, e.g., greater than 0.41, more preferably greater than 0.51, and most preferably greater than 0.60.

Preferably at least 40% of the head mass is disposed rearward of the geometric center of the body, more preferably at least 45% of the head mass is disposed rearward of the geometric center, and most preferably at least 50% of the head mass is disposed rearward of the geometric center.

The center of gravity is preferably disposed at about 38-56% of the maximum distance between the leading and trailing edges, more preferably at about 42-52% of the maximum distance between the leading and trailing edges, most preferably about 45-49% of the maximum distance between the leading and trailing edges (forward of the geometric center of gravity). In a particular embodiment, the center of gravity is disposed at about 47% of the maximum distance between the leading and trailing edges (forward of the geometric center).

In non-limiting implementations the body 12 can be made of a material having a density ranging from nine-tenths of a gram per cubic centimeter (0.90 g/cm3) to six grams per cubic centimeter (6.0 g/cm3.) The body 12 may weigh from one hundred grams to four hundred grams, more preferably from one hundred fifty grams to three hundred seventy grams, and in one non-limiting implementation the body 12 weighs three hundred forty four grams.

In non-limiting implementations the body 12 may be formed from a stainless steel alloy. Alternative non-limiting materials for the body 12 include aluminum alloys, titanium, titanium alloys, magnesium, magnesium alloys, steel alloys, composites (e.g., glass fiber reinforced polymers, carbon fiber reinforced polymers, metal matrix composites, ceramic matrix composites) and the like. The body 12 can be formed as a single cast structure using known casting techniques, such as centrifugal investment casting. However, those skilled in the art will recognize that alternative forming techniques such as milling, welding forged or formed pieces, and the like may be used.

While the particular GOLF PUTTER HEAD is herein shown and described in detail, it is to be understood that the subject matter which is encompassed by the present invention is limited only by the claims.

What is claimed is:

1. A golf putter head, comprising:

a body defining:

a continuous top edge defining a top leading edge, a top trailing edge, and top heel and toe edges extending from respective ends of the top trailing edge to respective ends of the top leading edge, tangents to the heel and toe edges intersecting at a point in front of the top leading edge;

a sole edge having a sole leading edge parallel to and coplanar with the top leading edge, sole heel and toe edges parallel to and coplanar with the top heel and toe edges;

a generally rectilinear sole plate extending from and integral with the sole leading edge and being joined to the top trailing edge by a connector plate ramping at on oblique angle relative to the sole plate and extending from the sole plate completely to the top trailing edge, the sole plate being distanced from the sole heel and toe edges by respective cavities;

heel and toe wings extending laterally outwardly from the top heel and toe edges adjacent the top leading edge, the heel and toe wings not extending laterally as far as the ends of the top trailing edge, the wings extending laterally beyond the top heel and toe edges adjacent the top leading edge and partially defining a leading surface; and a striking insert disposed on the body between the top and sole leading edges for striking a golf ball.

2. The putter head of claim 1, wherein the wings extend from the top leading edge to the sole leading edge.

3. The putter bead of claim 2, comprising heel and toe weights disposed on opposite sides of the sole plate closer to the top trailing edge than the top leading edge.

4. The putter head of claim 2, wherein the sole heel and toe edges curve inwardly and up to the top trailing edge.

5. The putter head of claim 1, comprising a central plate extending from the sole plate to the top leading and trailing edges, the central plate being oriented to also extend in a leading-to-trailing dimension centrally on the body, the central plate being perpendicular to the sole place, the central plate defining a visible top surface bearing an alignment aid.

6. A putter head comprising a substantially hollow unitary body with a generally wedge-shaped periphery and a leading surface less wide in a heel-to-toe dimension than a trailing portion of the head, leading heel and toe wings extending laterally outward from the periphery adjacent the leading surface and partially defining the leading surface, the body defining a generally rectilinear sole plate extending from and integral with a sole leading edge defined by the body and being joined to a top trailing edge defined by the body by a connector plate ramping at on oblique angle relative to the sole plate and extending from the sole plate completely to the top trailing edge, the sole plate being distanced from sole heel and toe edges by respective cavities, at least one flat receptacle plate merging into a junction of the top trailing edge with a top toe edge.

7. The head of claim 6, wherein the body defines:

a continuous top edge defining a top leading edge, the top trailing edge, and top heel and toe edges extending from respective ends of the top trailing edge to respective ends of the top leading edge, tangents to the heel and toe edges intersecting at a point in front of the top leading edge;

a sole edge having the sole leading edge parallel to and coplanar with the top leading edge, the sole edge including the sole heel and toe edges which are parallel to and coplanar with the top heel and toe edges;

heel and toe wings extending laterally outwardly from the top heel and toe edges adjacent the top leading edge, the heel and toe wings not extending laterally as far as the ends of the top trailing edge, the head also having a striking insert disposed on the body between the top and sole leading edges for striking a golf ball.

8. The putter head of claim 7, wherein the wings extend from the top leading edge to the sole leading edge.

9. The putter head of claim 8, comprising heel and toe weights disposed on opposite sides of the sole plate closer to the top trailing edge than the top leading edge.

10. The putter head of claim 8, wherein the sole heel and toe edges curve inwardly and up to the top trailing edge.

11. The putter head of claim 7, comprising a central plate extending from the sole plate to the top leading and trailing edges, the central plate being oriented to also extend in a leading-to-trailing dimension centrally on the body, the central plate being perpendicular to the sole plate, the central plate defining a visible top surface bearing an alignment aid.

12. A putter head comprising a leading surface configured for striking a golf ball, a trailing edge wider than the leading surface in a heel-to-toe dimension, and a central plate extending in a cavity formed therebetween and bearing alignment indicia visible to a golfer, the central plate extending from the trailing edge to the leading surface and extending from a top of the head to a sole of the head substantially throughout its length, a generally rectilinear sole plate extending from and integral with a sole leading edge and being joined to a top trailing edge by a connector plate ramping at on oblique angle relative to the sole plate and extending from the sole plate completely to the top trailing edge, the sole plate being distanced From the sole heel and toe edges by respective cavities.

13. The head of claim 12, wherein the body defines:

a continuous top edge defining a top leading edge, a top trailing edge, and top heel and toe edges extending from respective ends of the top trailing edge to respective ends of the top leading edge, tangents to the heel and toe edges intersecting at a point in front of the top leading edge;

a sole edge having a sole leading edge parallel to and coplanar with the top leading edge, sole heel and toe edges parallel to and coplanar with the top heel and toe edges;

heel and toe wings extending laterally outwardly from the top heel and toe edges adjacent the top leading edge, the heel and toe wings not extending laterally as far as the ends of the top trailing edge, the head also having a striking insert disposed on the body between the top and sole leading edges for striking a golf ball.

14. The putter head of claim 13, wherein the wings extend from the top leading edge to the sole leading edge.

15. The putter head of claim 14, comprising heel and toe weights disposed on opposite sides of the sole plate closer to the top trailing edge than the top leading edge.

16. The putter head of claim 14, wherein the sole heel and toe edges curve inwardly and up to the top trailing edge.

* * * * *